US005398469A

United States Patent [19]

Logan

[11] Patent Number: 5,398,469

[45] Date of Patent: Mar. 21, 1995

[54] DECORATIVE MOLDING STRIP

[75] Inventor: Richard Logan, Kingsville, Canada

[73] Assignee: Mid-America Building Products Corporation, Plymouth, Mich.

[21] Appl. No.: 158,163

[22] Filed: Nov. 24, 1993

Related U.S. Application Data

[63] Continuation of Ser. No. 916,399, Jul. 20, 1992, abandoned.

[51] Int. Cl.[6] ..... E04F 19/04

[52] U.S. Cl. ..... 52/288.1; 52/287.1; 52/272; 52/257

[58] Field of Search ..... 52/287, 280, 288.1, 52/272, 253, 254, 255, 241, 716, 273, 257

[56] References Cited

U.S. PATENT DOCUMENTS

| | | | |
|---|---|---|---|
| 417,949 | 12/1989 | Sagendorph | 52/287 |
| 1,229,765 | 6/1917 | Lehman | 52/287 |
| 2,114,044 | 4/1936 | Bonnell | 52/280 |
| 3,201,910 | 8/1965 | Keesee | 52/287 |
| 3,302,350 | 2/1967 | Brown et al. | 52/287 |
| 3,464,177 | 9/1969 | Amato | 52/288 MF |
| 3,481,092 | 12/1969 | Constantino | 52/288 |
| 3,616,587 | 11/1971 | Schlafly, Jr. | 52/288 |
| 4,091,586 | 5/1978 | Schwartz | 52/288 MF |
| 4,709,522 | 12/1987 | Carnahan | 52/287 |
| 5,001,877 | 3/1991 | Edwards | 52/288 |

FOREIGN PATENT DOCUMENTS

| | | | |
|---|---|---|---|
| 7413048 | 4/1976 | Netherlands | 52/288 |
| 2191518 | 12/1987 | United Kingdom | 52/288 |
| 0567798 | 8/1977 | U.S.S.R. | 52/287 |

*Primary Examiner*—Carl D. Friedman
*Assistant Examiner*—Winnie S. Yip
*Attorney, Agent, or Firm*—Barnes, Kisselle, Raisch, Choate, Whittemore & Hulbert

[57] ABSTRACT

A decorative molding for a corner formed by a ceiling and a vertical wall comprises a thin strip of flexible plastic and is secured to the wall by an attachment allowing the molding strip along its upper and lower edges to be flexible to conform with uneven surfaces in the ceiling and/or wall. In one form the strip is attached to the wall by an adhesive. In another form, a wall track and clip arrangement is utilized to provide easy removal from the wall for paint or wallpaper application. A corner element is provided in one form in which ends of the strips are adhesively secured thereto in overlapping engagement. In another embodiment, the strips are telescopically connected to the corner element.

10 Claims, 3 Drawing Sheets

DECORATIVE MOLDING STRIP

This is a continuation of application Ser. No. 07/916,399, filed on Jul. 20, 1992, now abandoned.

BACKGROUND OF THE INVENTION

This invention relates to decorative molding installed at a corner formed by the juncture of a ceiling and a vertical wall. Particularly, this invention relates to systems for mounting the molding to the corner.

In the past, various moldings have been provided as disclosed and described, for example, in U.S. Pat. Nos. 3,302,350; 3,481,092 and 3,616,587. These patents disclose various methods of attaching the molding strip to the corner juncture. However, these methods are undesirable in that the mounting is permanent and/or rigid causing difficulties in modifying decorative features of a house in many applications. For example, in many older homes the surface of the walls and ceilings are uneven due to settling of the house or water damage, for example. Firm and secure attachment of the prior art devices would be difficult due to the fact that the upper and lower surfaces of the molding are rigidly and/or permanently attached to the ceiling and wall. In Brown et al ('350) the walls of the mounting member are rigidly connected to the ceiling and wall by screws. The Constantino ('092) device is attached by applying adhesive to the flat upper and lower edges of the molding. In Schlafly, Jr. ('587) the upper and lower edges of the molding are rigidly attached to the walls by clips. Thus, it can be seen that the rigid mounting of these prior art devices do not allow the molding to conform or adjust to uneven wall surfaces.

The present invention overcomes these difficulties by providing a mounting system that allows the flexible decorative molding to conform to uneven surfaces in a wall and/or ceiling.

SUMMARY OF THE INVENTION

Among the objectives of this invention are to provide a mounting system for decorative molding that is flexible allowing the strip to conform to expansion, contraction or uneven surfaces in the wall and/or ceiling yet secure enough to adequately maintain the molding in place; that is easy to install requiring little or no skills; that is easily removable to allow for painting, wallpaper application or other decorating features; and that provides an attractive and decorative molding that is less costly than wood moldings, can be supplied with a pre-finished wood grain, and can be stained or painted.

DETAILED DESCRIPTION

The invention provides a decorative molding strip made of molded plastic material such as polystyrene, for example, and is vacuum or pressure formed into flexible strips thin enough to flex lengthwise as well as about the width.

Figure 1:
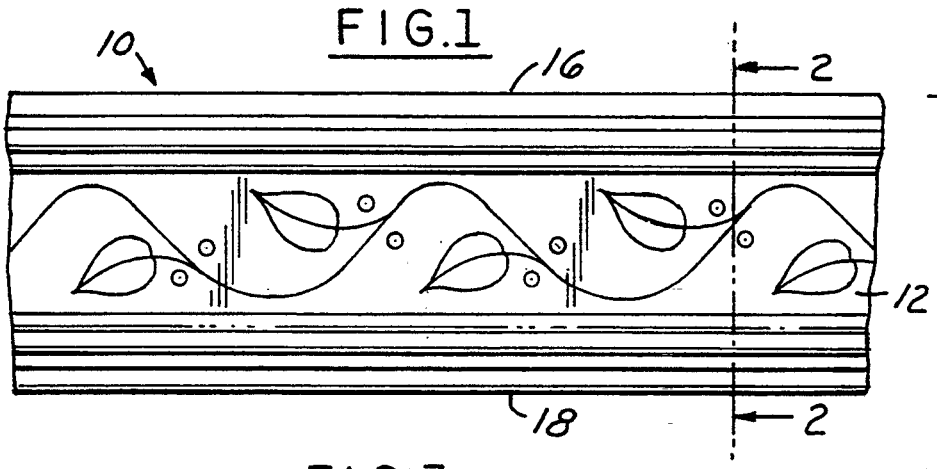
FIG. 1 is a front elevational view of a first embodiment of the molding strip.

FIGS. 1–8 show a first system for mounting various embodiments of the molding strip which comprises an adhesive attachment. FIG. 1 shows a first embodiment of the invention where molding strip 10 has a decorative front surface 12, a back surface 14 an upper edge 16 and a lower edge 18. An adhesive 20, for example, double sided pressure sensitive tape, is attached to the back surface 14 of the strip 10. The strip with the adhesive is then attached to a vertical wall (shown in phantom). The upper edge 16 fits snugly against the vertical wall at the point of intersection between the wall and the ceiling. The lower edge 18 is also resiliently held against the vertical wall.

FIGS. 3–8 show several other embodiments of molding strips having various designs and contours. The upper edges are angled outwardly from the wall to which the strip is mounted so as to engage the ceiling thus giving the appearance of angled corner molding as opposed to flat molding as appears in the embodiment of FIGS. 1 and 2. The only differences between the embodiments of FIGS. 3–8 are the decorative features of the front faces 24, 34, 44 and the angle of inclination of the upper edges 28, 38, 48. The molding strips are mounted to a vertical wall by an adhesive strip 31, 41, 51 in the same manner as molding strip 10 of FIG. 1. However, the upper edges 28, 38, 48 resiliently and snugly bear against the ceiling for firm engagement therewith. The upper edges may be flexed about their respective mounting adhesive strips from the unflexed position (shown in phantom) prior to mounting to the final flexed position shown in solid lines in FIGS. 4, 6 and 8. The lower edges 30, 40, 50 are resiliently and snugly held against the vertical wall.

Figure 4:
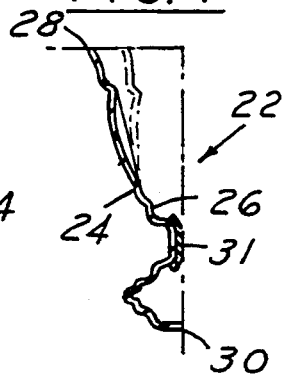
FIG. 4 is a sectional view taken along the line 4—4 in FIG. 3.
Figure 5:
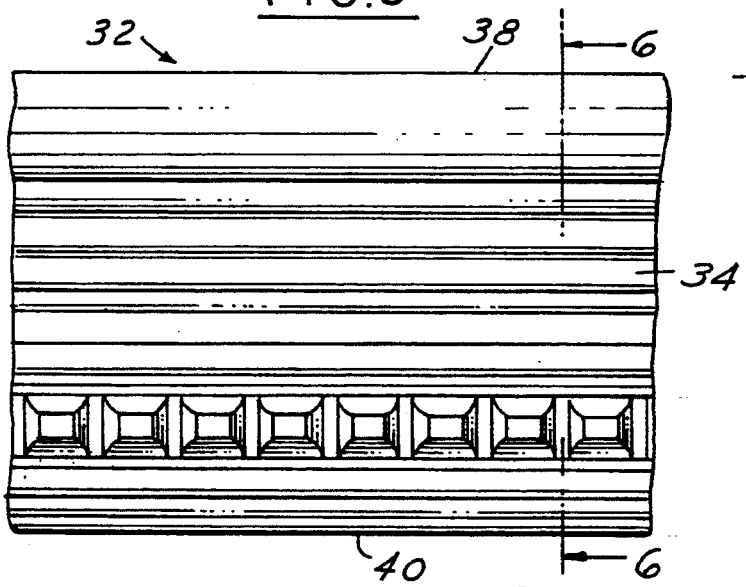
FIG. 5 is a front elevational view of a third embodiment of the molding strip.
Figure 6:
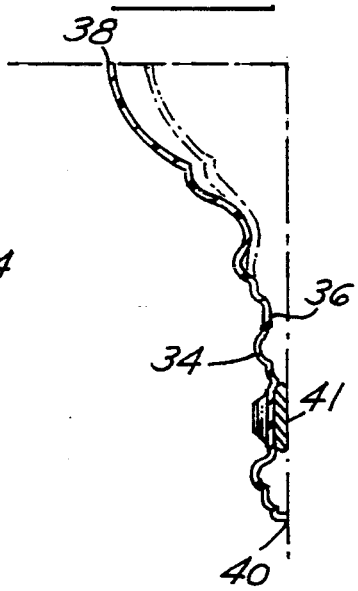
FIG. 6 is a sectional view taken along the line 6—6 in FIG. 5.
Figure 23:
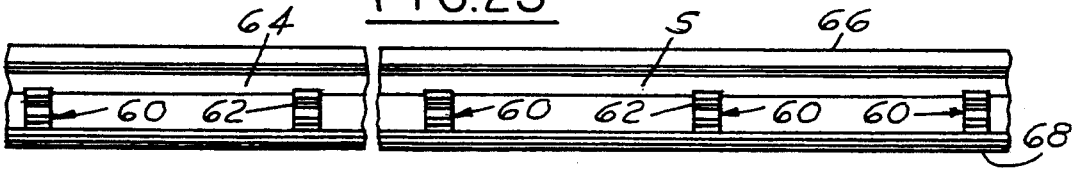
FIG. 23 is a fragmentary rear elevational view of a molding strip with a plurality of flexible plastic clips attached thereto.
Figure 7:
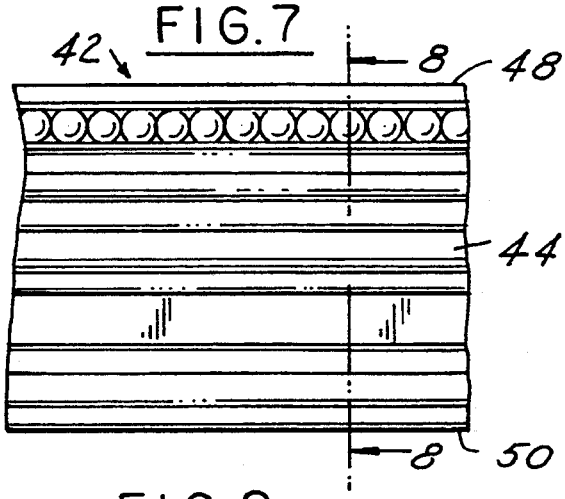
FIG. 7 is a front elevational view of a fourth embodiment of the molding strip.
Figure 8:
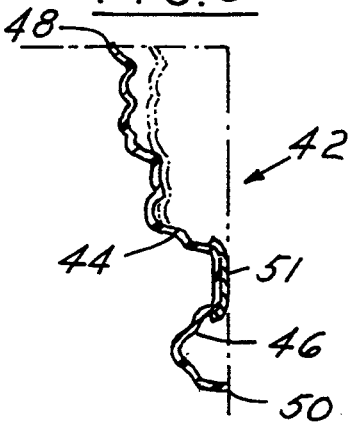
FIG. 8 is a sectional view taken along line 8—8 in FIG. 7.

One feature common to all of the above embodiments is that at least the upper edges, and preferably the lower edges, are flexed about the point of attachment to the wall, i.e. about the adhesive strip, for example at 31 in FIG. 4. Regarding FIGS. 1 and 2, the flexing of the upper and lower edges 16, 18 would not be as dramatic as seen in the embodiments of FIGS. 3–8; however, enough flexing occurs to enable the upper and lower edges 16, 18 to be resiliently flexed into snug engagement with the vertical wall.

Figure 9:
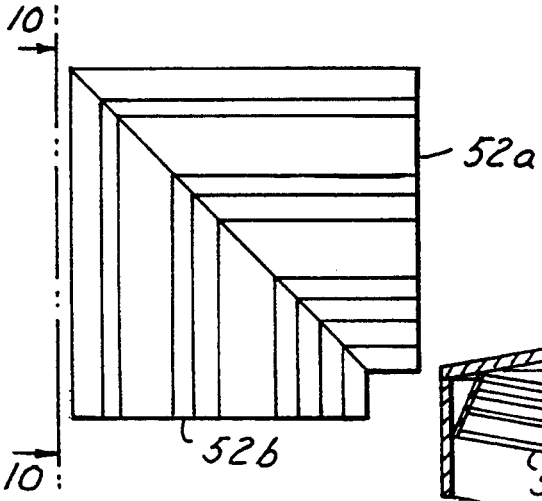
FIG. 9 is a plan view of a corner molding element.
Figure 10:
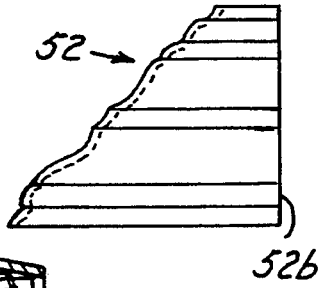
FIG. 10 is a sectional view taken along the line 10—10 in FIG. 9.
Figure 11:
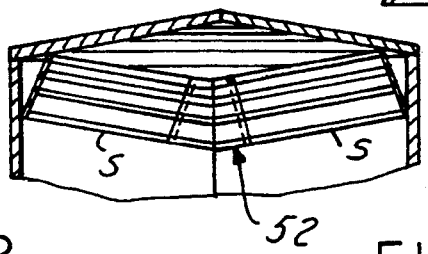
FIG. 11 is a fragmentary perspective view of the molding strips and corner piece in place.
Figure 12:
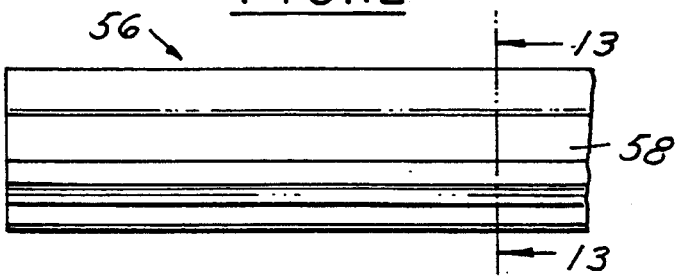
FIG. 12 is a front elevational view of a wall track.
Figure 13:
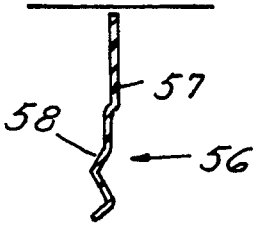
FIG. 13 is a sectional view taken along the line 13—13 in FIG. 12.

FIGS. 9 and 10 show a corner molding element 52 used with molding strips of similar transverse configuration, the ends of which would either abut or, preferably, slightly overlap behind the ends 52*a*, 52*b* of the corner element 52 and which are secured thereto by adhesive means. For example, in FIG. 11 the ends of the molding strips S adjacent the corner element 52 are adhesively secured in overlapping engagement behind the ends 52*a*, 52*b* of the corner element. The corner piece is then supported by the molding strips and, as shown mounted to molding strips S in FIG. 11, is used to eliminate the requirement of mitering the ends of the molding strips for a corner fit.

Figure 2:
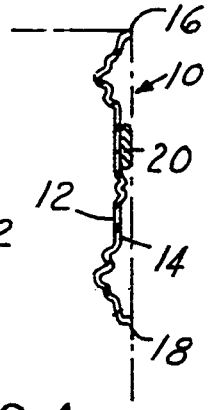
FIG. 2 is a sectional view taken along the line 2—2 in FIG. 1.
Figure 3:
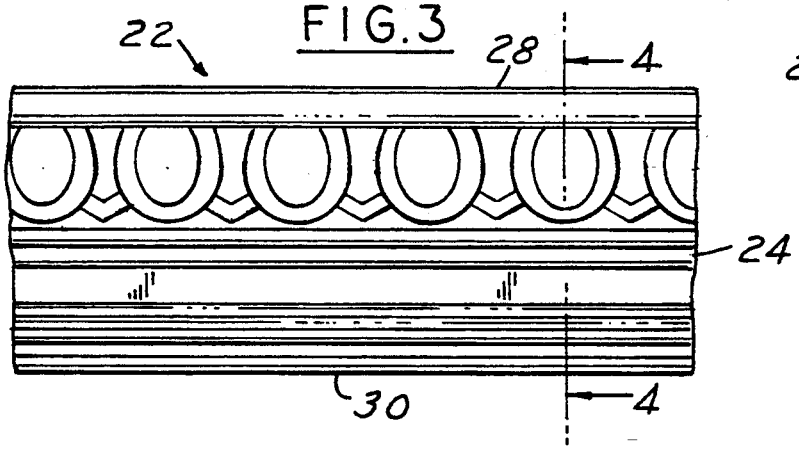
FIG. 3 is a front elevational view of a second embodiment of the molding strip.
Figure 14:
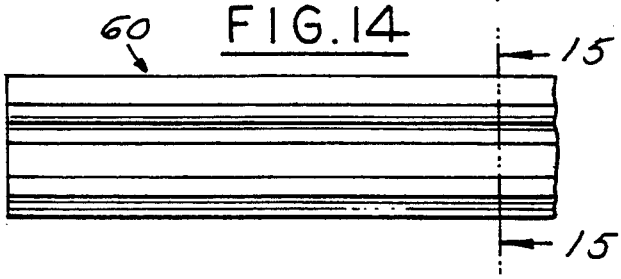
FIG. 14 is front elevational view of a mounting clip.
Figure 15:
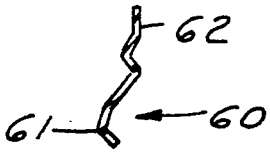
FIG. 15 is a sectional view taken along the line 15—15 in FIG. 14.
Figure 16:
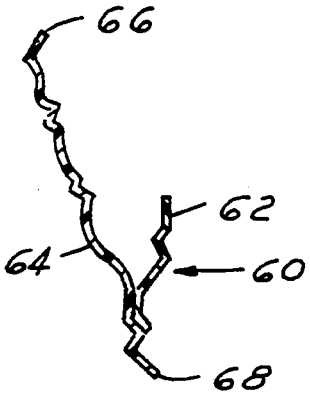
FIG. 16 is an end view of a molding strip with a mounting clip attached.
Figure 17:
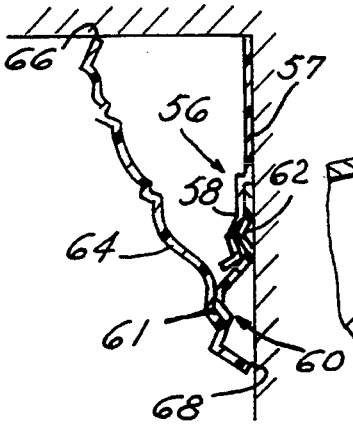
FIG. 17 is an end view of a molding strip mounted to a wall.
Figure 20:
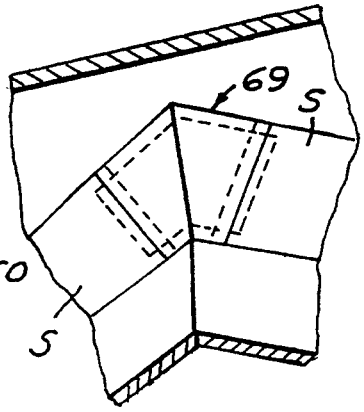
FIG. 20 is a fragmentary perspective view of the molding strips and corner piece attached to the walls.
Figure 18:
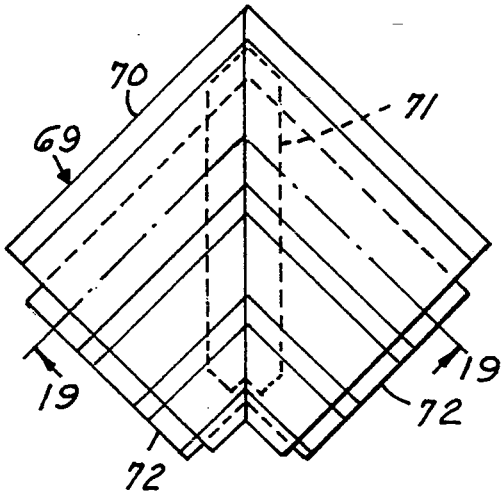
FIG. 18 is a plan view of a modified corner molding element.
Figure 19:
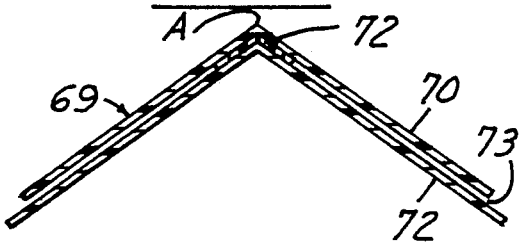
FIG. 19 is a sectional view taken along the line 19—19 in FIG. 18.

FIGS. 12–17 show a second embodiment of the mounting system. This system comprises a wall track 56 (FIGS. 12, 13) and a plurality of short clips 60 (FIGS. 14, 15). The wall track 56 is comprised of a thin plastic piece which has a back surface 57 adapted to be mounted on a wall and a forward leading edge 58 spaced therefrom providing a gap between the leading edge 58 and the wall. The wall track 56 runs substantially the length of the molding strip to be mounted thereon. The upper edge of the wall track 56 abuts the ceiling to give the proper spacing to allow the upper edge 66 of the molding strip 64 to fit tightly against the ceiling. The wall track is mounted by any means, such as adhesive similar to adhesive 20 (FIG. 2). The clips 60 (FIG. 15) are a thin piece of plastic adapted to be mounted to the back surface of a molding strip 64 at a point 61 (FIG. 15) at spaced locations therealong and have a forward edge 62 adapted to be received within the gap between the forward leading edge 58 of the wall track and the wall (FIG. 17). The leading edge 58 of the wall track is flexible about its mounting point 57 to receive the leading edges 62 of the clips in a snap action fit to resiliently but firmly hold the molding strip in place. As can be seen in FIG. 17, upper edge 66 is flexed about the point 61 at which the clip is mounted to the back surface of the molding strip. Similarly, the lower edge 68 is flexed about the same point to be snugly received against the vertical wall.

One advantage of the embodiments of FIGS. 12–17 is that the molding strip 64 can be easily removed via the snap action fit to allow for painting, wallpapering or other decoration.

Also, the molding strips of the above embodiments are flexible about .their lengths as well as their widths to provide conforming engagement with uneven wall surfaces and to allow for expansion and contraction due to weather and/or temperature conditions. For instance, when mobile or modular homes are stored, the interior temperature can exceed 125° F.

Figure 21:
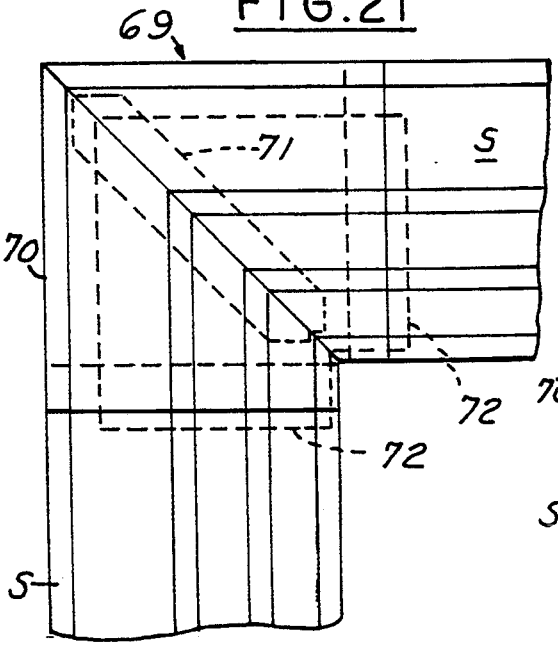
FIG. 21 is a front view of the mounting strips attached to the modified corner molding element shown in FIG. 18.
Figure 22:
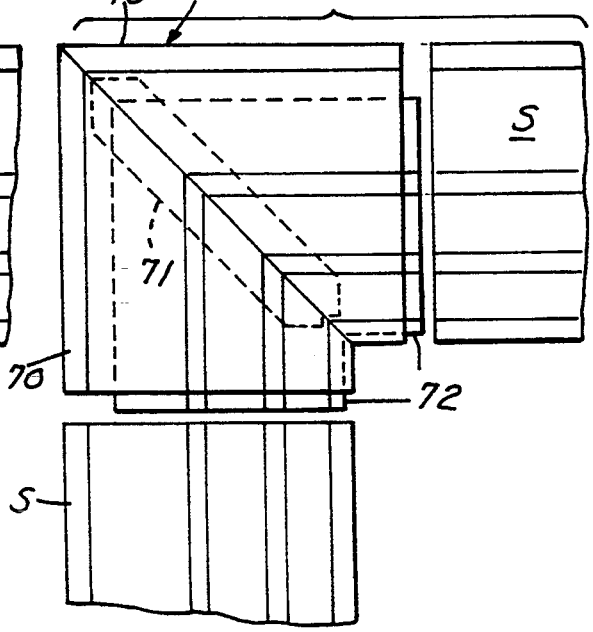
FIG. 22 is an exploded view of the molding strips and the modified corner molding element shown in FIG. 21.

FIGS. 18–22 show a modified corner molding element 69 adapted for use with molding strips of similar transverse configuration. This embodiment comprises an upper corner element 70 and a lower corner element 72 attached along the apex A by securing means 71, such as an adhesive, leaving a small gap 73 between the upper and lower corner elements 70, 72. The gap 73 is adapted to telescopically receive ends of molding strips S having similar configurations to the corner molding pieces in snug and secure telescopic engagement (FIGS. 21, 22). For example, FIG. 22 shows the molding strips S and corner elements 70, 72 prior to connection. The ends of the strips S are then inserted into gap 73 (FIG. 19) at each end of the corner element 69 (FIG. 21). The resulting mounting arrangement for an outside corner appears in FIG. 20. However, it is understood that the corner molding element 69 is also adapted for use with an inside corner. The corner molding element is then supported by the molding strips S.

It can thus be seen that a decorative molding mounting system has been provided that is flexible and able to conform to uneven wall surfaces, is easy to install, is easily removable for wallpaper application or painting and is less costly than wood moldings.

It is claimed:

1. A decorative molding system removably installed at a juncture of a ceiling and a vertical wall, said molding system comprising:

a thin molding strip of flexible plastic having a length and a width, said thin plastic molding strip having an undulating cross sectional configuration;

said thin plastic molding strip having an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, said upper free edge and lower free edge having a configuration such that the molding strip is angled outwardly with respect to the wall and the ceiling, a plurality of flexible plastic clips, each said flexible plastic clip having a first end and a second free end, said flexible plastic clips being attached at spaced points along the length of the back surface of said molding strip at a point of attachment intermediate the upper free edge and lower free edge of said molding strip and said second free end of each said clip extends at an acute angle relative to the molding strip from said point of attachment, said second free end of each said clip being capable of flexing relative to said point of attachment to said molding, said molding strip being sufficiently flexible about its length as well as its width to provide conforming engagement of its upper free edge and its lower free edge with the ceiling and vertical wall to provide conforming engagement with the ceiling and vertical wall, a wall track of thin flexible plastic having a back surface, a front surface, an upper edge and a forward leading edge, said forward leading edge of said track being capable of flexing relative to the remainder of said track, means for mounting the upper edge of the track on one of said ceiling and said vertical wall adjacent the juncture of said ceiling and said vertical wall, first interengaging means integral with said forward leading edge of said track, second interengaging means integral with said second free end of each said clip, said first interengaging means and said second interengaging being constructed such that when the thin molding strip with the flexible plastic clips attached thereto is mounted on said track by movement of each said second free end of each said clip between the leading edge of said track, the second free end of each said clip is moved toward the leading edge of the track and said flexible forward leading edge of said track and said free ends of said clips flex and said first interengaging means interengage, such that said thin molding strip is restrained against ready removal, said molding strip, clips and track being constructed and arranged such that when said molding strip is in mounted position on said wall track, the upper edge of said molding strip is angled outwardly from said track and said clips, such that each said clip is positioned between said lower forward free edge of said wall track and its associated wall to cause the forward leading edge of said track to flex so that each said clip is retained by a snap-in fit while permitting the upper free edge and lower free edge of said molding strip to flex into conforming engagement with the ceiling and vertical wall and said strip is removable by flexing of said clips, said first interengaging means on said forward leading edge of said track and said second interengaging means on said clips being constructed and arranged such that the molding strip can be easily removed to allow for painting, wall papering, or other decoration.

2. The decorative molding system set forth in claim 1 wherein each said first interengaging means and second interengaging means comprises an integral undulating configuration, said configuration on said track being generally complementary to said configuration on said clips.

3. The decorative molding system set forth in claim 1 comprising a corner molding having an upper corner element and a lower corner element having complementary cross-sectional configurations and joined together in a spaced relation forming a gap at each end thereof, such that when said corner molding is mounted, an end of said molding strip is received within the gap formed by the upper and lower corner elements at each end thereof, respectively, so that said corner molding is supported solely by said molding strips at each end thereof.

4. The decorative molding system set forth in claim 3 wherein said corner molding accommodates an inside corner.

5. The decorative molding system set forth in claim 3 wherein said corner molding accommodates an outside corner.

6. The decorative molding system set forth in any one of claims 1–5 wherein said molding strip, clips and track are made of substantially the same thickness of plastic.

7. The decorative molding system set forth in claim 6 wherein said track is mounted on the vertical wall.

8. The decorative molding system set forth in claim 7 wherein said thin molding strip is vacuum formed into said undulating cross sectional configuration.

9. The decorative molding system set forth in claim 8 wherein one surface of said molding strip comprises a wood grain.

10. The decorative molding system set forth in claim 9 wherein said one surface is capable of being stained or painted.

* * * * *